US006333722B1

(12) United States Patent
Kitano

(10) Patent No.: US 6,333,722 B1
(45) Date of Patent: Dec. 25, 2001

(54) HELICAL ANTENNA WITH ADJOINING INSULATOR UNITS

(75) Inventor: Shinichiro Kitano, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/588,729

(22) Filed: Jun. 7, 2000

(30) Foreign Application Priority Data

Jun. 8, 1999 (JP) ..... 11-160987

(51) Int. Cl.[7] ..... H01Q 1/36
(52) U.S. Cl. ..... 343/895
(58) Field of Search ..... 343/895, 702

(56) References Cited

U.S. PATENT DOCUMENTS 5,587,719 * 12/1996 Steffy ..... 343/895
6,018,326 * 1/2000 Rudisill ..... 343/895
6,150,994 * 11/2000 Winter et al. ..... 343/895
6,163,307 * 12/2000 Kim et al. ..... 343/895

* cited by examiner

*Primary Examiner*—Tan Ho
(74) *Attorney, Agent, or Firm*—Young Thompson

(57) ABSTRACT

A helical antenna permitting a diminution in dielectric loss includes an antenna section divided into short insulator units with a molded body over which antenna elements are helically would, and the insulator units are connected in tandem. The relationship among the insulator units is so configured that, when they are fitted into one another for connection, the end faces of element units constituting the antenna elements are brought into electric face contact with each other.

11 Claims, 3 Drawing Sheets

HELICAL ANTENNA WITH ADJOINING INSULATOR UNITS

BACKGROUND OF THE INVENTION

1. Field of the Invention

The present invention relates to an helical antenna, and more particularly to a helical antenna having an antenna section configured by providing insulator bodies with helical conductors.

2. Description of the Related Art

FIG. 6 illustrates a conventional helical antenna. The helical antenna is configured by providing a strip or strips of helical conductor 12 around the circumference of a cylindrical molded body 11 of an insulating material (e.g. resin) having a hollow 11*a* in the center. The helical conductor 12 can be formed by winding a wire of copper or some other material helically or by printed wiring. In providing the helical conductor 12, a helical groove may be formed around the circumference of the cylindrical molded body 11 to prevent the conductor from slipping out of place. Such a helical antenna has an advantage of reduced overall length over a vertical antenna of a ¼ wavelength or the like, consisting of a single conductor standing vertically. The presence of the hollow 11*a* in the center of the molded body 11 provides an additional advantage of reduced dielectric loss.

However, the conventional helical antenna, while its dielectric loss is reduced by providing the hollow 11*a*, involves the problem that thinning the thickness of the molded body 11 to further reduce its dielectric loss and its weight at the same time would weaken the strength or the molded body 11 and make it more difficult for the molded body to be drawn out of the mold.

SUMMARY OF THE INVENTION

An object of the present invention is to provide a helical antenna permitting a further diminution in dielectric loss, easier drawing and a reduction in weight.

In order to achieve the object stated above, according to the invention, there is provided a helical antenna consisting of a cylindrically shaped insulating body over which an element is helically laid, the cylindrical insulating body consisting of a plurality of insulator units presenting a cylindrical shape when combined, and said element consisting of a plurality of element units formed over said plurality of insulator units and having end parts which, when said plurality of insulator units are combined, are electrically connected in the connecting part.

According to this configuration, a cylindrical insulator body is manufactured in a form divided into a plurality of insulator units, and to the insulator units, when they are combined with one another into a single cylindrical insulator body, the end parts of the elements are electrically connected at the same time. As the unitized manufacture facilitates fabrication using molds or the like, it is made possible to thin the thickness of the insulatorunits, i.e. that of the cylindrical insulator body, reduce dielectric loss and enhance the antenna performance, and the thinner insulator units , would be made correspondingly lighter in weight.

DETAILED DESCRIPTION OF PREFERRED EMBODIMENTS OF THE INVENTION

Preferred embodiments of the present invention will be described below with reference to accompanying drawings.

Figure 1:
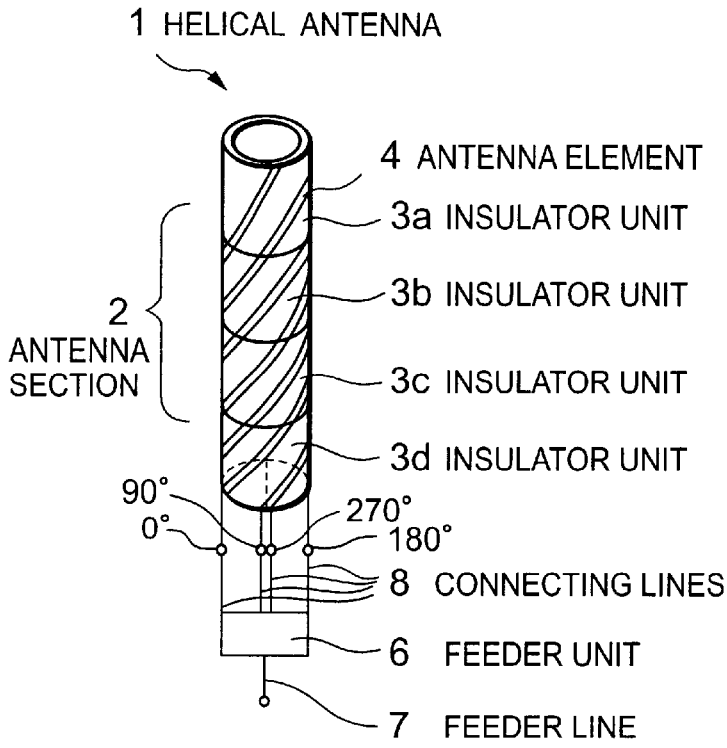
FIG. 1 is a perspective view of a helical antenna according to the present invention.
Figure 2:
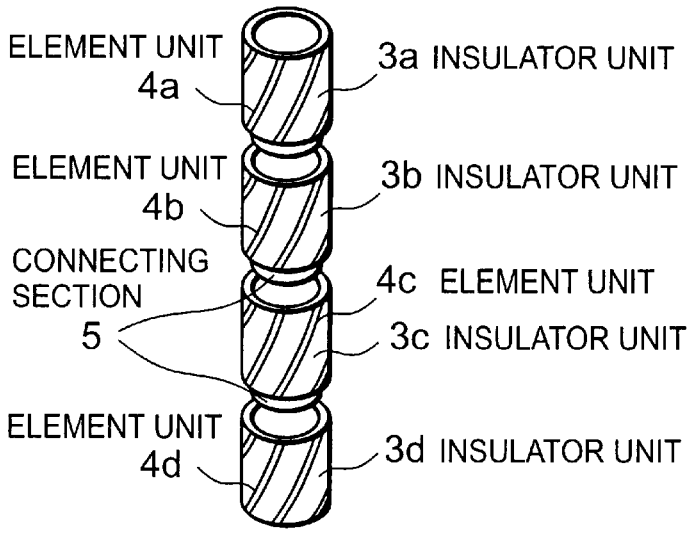
FIG. 2 is an exploded perspective view showing the configuration of the individual units of the antenna section 2 in FIG. 1.

FIG. 1 illustrates a helical antenna according to the invention. Further, FIG. 2 shows an exploded view of the helical antenna of FIG. 1. A helical antenna 1 according to the invention has an antenna section 2 structured of four insulator units 3*a*, 3*b*, 3*c* and 3*d* of the same length connected in tandem. When the four insulator units 3*a* through 3*d* are connected and excited, a desired tuning frequency is obtained. Each of the insulator units 3*a* through 3*d*, as illustrated in FIG. 2, is fabricated of an MID (molded interconnected device) of the like, and over each of the insulator units 3*a* through 3*d* are arranged in parallel a plurality of (four in this example) antenna elements (helical conductors) 4 to draw helixes from the upper end of the insulator unit 3*a* to the lower end of the insulator unit 3*d*. The antenna elements 4 consist of element units 4*a* through 4*d* each provided for one or another of the insulator units 3*a* through 3*d*, and the element units are so disposed as to be electrically connected by contact pressure to the respectively adjoining element units when the insulator units 3*a* through 3*d* are connected to one other. While the element units 4*a* through 4*d* here consist of four pieces each, it is acceptable to shape only one of them helically.

To facilitate the connection of the four insulator units 3*a* through 3*d*, as illustrated in FIG. 2, with the exception of the lowermost unit, the lower end of each of the upper three insulator units 3*a* through 3*c* is provided with a connecting section 5 of a smaller external diameter (resulting in a convex cross-sectional shape) so that it can fit the upper end of the immediately lower unit. Since each of the insulator units 3*a* through 3*d* is short, unlike in the conventional practice of fabricating a solid long molded body, it can be built thin and thereby made less susceptible to the influence of the dielectric part, resulting in reduced loss and reduced weight.

Below the antenna section 2 is disposed an feeder unit (a four-way allotter in this particular embodiment) 6 connected to a feeder line 7. This feeder unit 6 has output terminals set in four phase differences of 0 degree, 90 degrees, 180 degrees and 270 degrees, and the four end parts of the element units 4*d* are connected to these output terminals. These four end parts of the element units 4*d* and the feeder unit 6 are connected by four connecting lines 8.

Figure 3:
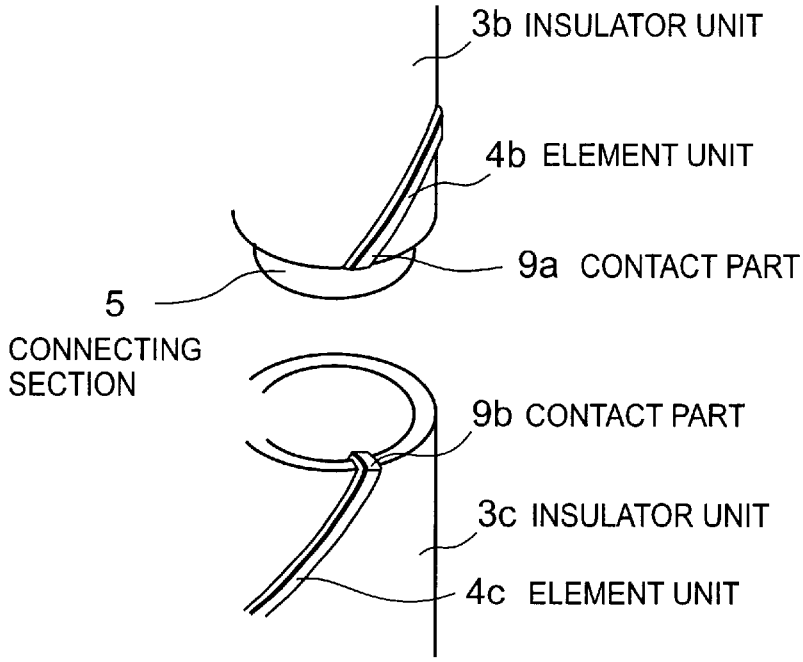
FIG. 3 is a partial expanded view showing the detailed configuration of the connecting part 5 of the insulator units 3*a* through 3*d*.

FIG. 3 illustrates the details of element units of connecting section 5. To focus on the insulator units 3*b* and 3*c* for example, as the respective end parts of the element unit 4*b* of the insulator unit 3*b* and of the element unit 4*c* of the insulator unit 3*c* are bent at a right angle, and contact parts 9*a* and 9*b* are exposed over the end faces of the insulator units 3*b* and 3*c*, respectively, the contact parts 9*a* and 9*b* are brought into contact with each other by matching the contact parts 9*a* and 9*b* of the element units 4*b* and 4*c* when the insulator units 3*b* and 3*c* are combined, and electric continuity is established between the element units 4*b* and 4*c*. By soldering together the contact points of the contact parts 9*a* and 9*b* or adjoining areas, the reliability of the connection can be further enhanced.

In the configuration described above, an electromagnetic wave fed to the feeder unit 6 via the feeder line 7 is divided by the feeder unit 6 into four equal parts, each of which is fed to one or another of four lines of antenna elements 4 formed on the insulator units 3*a* through 3*d*. In the configuration illustrated in FIG. 1, the electromagnetic waves fed to the antenna elements 4, having relative phases of 0°, 90°, 180° and 270°, are excited by the antenna elements 4 and radiated into the air as radio waves.

Figure 4:
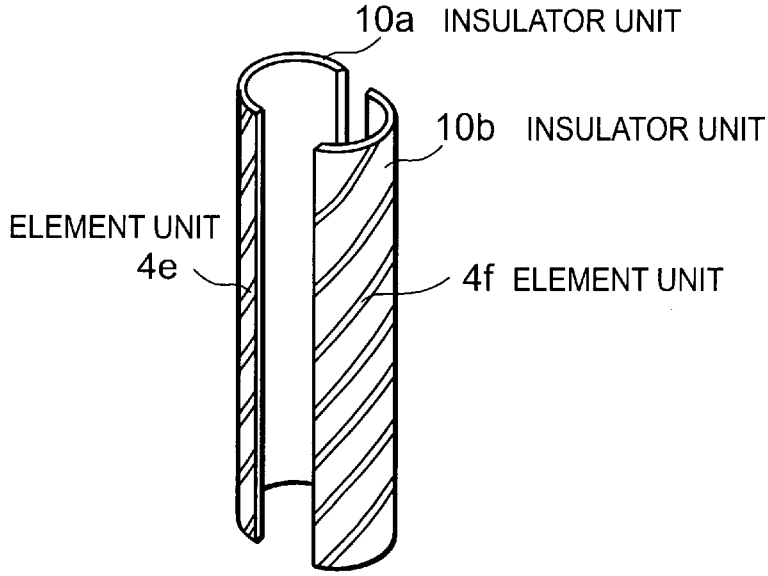
FIG. 4 is a perspective view of a helical antenna which is a second preferred embodiment of the invention.

FIG. 4 illustrates a helical antenna which is a second preferred embodiment of the present invention. Although the foregoing configuration has an antenna section divided in the lengthwise direction into the four insulator units 3*a* through 3*d*, the invention is not limited to this arrangement, but can use other ways of division as well. One specific example of such alternative division is shown in FIG. 4, wherein insulator units 10*a* and 10*b* resulting from bisecting along the center line are placed opposite to each other. In this case, the antenna elements 4 are provided over the surface of the insulator units 10*a* and 10*b*, and the end parts of the element units 4*e* through 4*f* are treated in the same way as illustrated in FIG. 3, so that electric connection be established by the coming into contact of the end faces (contact parts).

Figure 5:
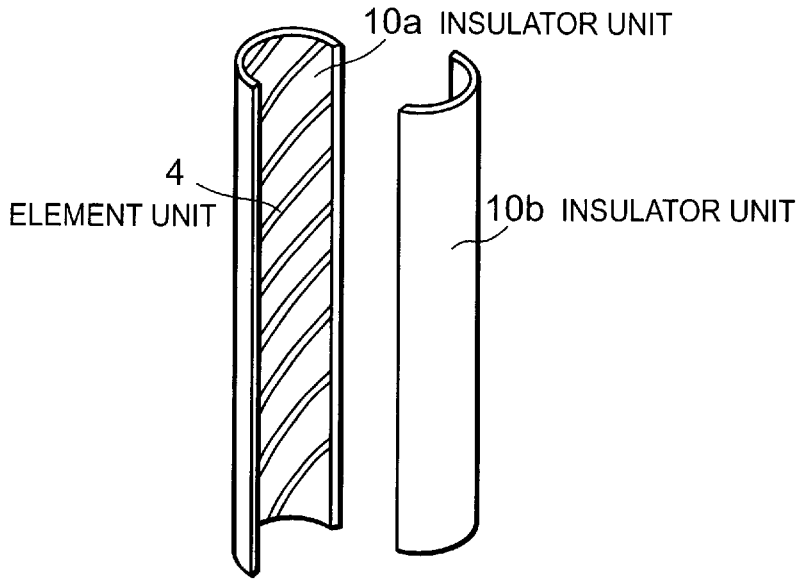
FIG. 5 is a perspective view of a helical antenna which is a third preferred embodiment of the invention.
Figure 6:
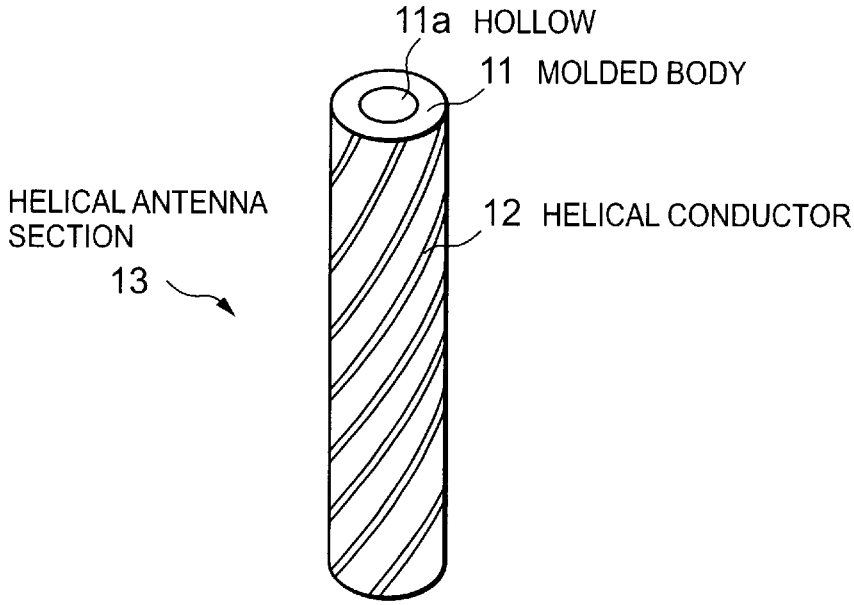
Fig.6 (PRIOR ART)
FIG. 6 is a perspective view of a helical antenna according to the prior art.

FIG. 5 illustrates a helical antenna which is a third preferred embodiment of the present invention. While this embodiment is the same as that shown in FIG. 4 in the shape and the way of division of the insulator units 10*a* and 10*b*, it differs from the foregoing in that the antenna elements 4 are provided over the inner wall. This arrangement of the antenna elements 4 over the inner wall can also be applied to the configurations of FIG. 1 and FIG. 2.

According to the invention, it is also possible to accomplish division in such a manner that the end parts become oval along the element units (or the antenna elements). In this configuration, conductor connection between the units is not required because conductors are not cut off.

Incidentally, while MIDs are used as units in the foregoing embodiments, the units may be made of some other material such as printed boards or a foamed material. Further, although the insulator units 3 are connected by mutual plugging in according to the configurations of FIG. 1 and FIG. 2, they may as well be fixed by connection with an adhesive, taping, welding or soldering of the conductors. In addition, while the number of units is four in the foregoing embodiments, they may be provided in any number not less than two.

Furthermore, the shape of the insulator units is not limited to cylindrical, but may be, for instance, conical, prismatic or pyramidal. The examples use four helical lines, but the number of helical lines may be one, two or any greater.

As hitherto described, a helical antenna according to the present invention has a cylindrical insulator body consisting of a plurality of insulator units which present a cylindrical shape when connected together, and the plurality of insulator units are provided with element units so that they can be electrically connected by their connecting section when the plurality of insulator units are connected together. Therefore, unitized manufacture of the helical antenna facilitates fabrication using molds or the like, making it possible to thin the thickness of the insulator units, i.e. that of the cylindrical insulator body, reduce dielectric loss and enhance the antenna performance. The thinner insulator units would be correspondingly lighter in weight.

What is claimed is:

1. A helical antenna having a cylindrical insulator body over which elements are laid on external surface, comprising:

said cylindrical insulator body composed of a plurality of insulator units which present a cylindrical shape when connected together, and said element composed of a plurality of element units formed over said plurality of insulator units, the element units having connecting end parts which, when said plurality of insulator units are combined adjoining by contact, are electrically connected by the connecting end parts.

2. A helical antenna, as claimed in claim 1, wherein the plurality of units have connecting end parts of conductors extending over the connecting faces of adjoining units.

3. A helical antenna, as claimed in claim 1, wherein the plurality of units are divided in the lengthwise direction.

4. A helical antenna, as claimed in claim 1, wherein the plurality of units are divided in the radial direction.

5. A helical antenna having a cylindrical insulator body over which elements are laid on internal surface, comprising:

said cylindrical insulator body composed of a plurality of insulator units which present a cylindrical shape when connected together, and said element composed of a plurality of element units formed over said plurality of insulator units , the element unit having contact end parts which, when said plurality of insulator units are contactingly adjoined, are electrically connected via the contact end parts.

6. A helical antenna, as claimed in claim 5, wherein the plurality of units have contact end parts of conductors extending over the connecting faces of adjoining units.

7. A helical antenna, as claimed in claim 5, wherein the plurality of units are divided in the lengthwise direction.

8. A helical antenna, as claimed in claim 5, wherein the plurality of units are divided in the radial direction.

9. A helical antenna, comprising:

a base element composed of a cylindrical base insulator unit with an open upper end, and plural antenna elements formed on a surface of the base insulator unit; and at least one further element composed of a cylindrical insulator unit of a first outside diameter, the further element cylindrical insulator unit having a connecting section at a lower end of a second outside diameter less than the first outside diameter, and plural antenna elements formed on a surface of the further element cylindrical insulator unit, wherein in an assembled condition, the at least one further element is joined to the base element by the connecting section of the at least one further element being inserted into the open upper end of the base insulator unit and the plural antenna elements of the base element are adjoined by contact with the plural antenna elements of the at least one further element.

10. The helical antenna of claim 9, wherein, the open upper end of the base insulator unit has an upper end surface adjoining the surface of the base insulator unit and the plural antenna elements of the base element extend from the surface of the base insulator unit onto the upper end surface.

11. The helical antenna of claim 10, wherein, the plural antenna elements of the at least one further element contact the plural antenna elements of the base element at the upper end surface of the base insulator unit.

* * * * *